US007277009B2

(12) United States Patent
Hall et al.

(10) Patent No.: US 7,277,009 B2
(45) **Date of Patent: *Oct. 2, 2007**

(54) CARGO LOCK AND MONITORING APPARATUS AND PROCESS

(75) Inventors: Larry L. Hall, Carlsbad, NM (US); Duane S. Schmoker, Richland, WA (US)

(73) Assignee: Services LLC, Aiken, SC (US)

( * ) Notice: Subject to any disclaimer, the term of this patent is extended or adjusted under 35 U.S.C. 154(b) by 61 days.

This patent is subject to a terminal disclaimer.

(21) Appl. No.: 11/390,035

(22) Filed: Mar. 27, 2006

(65) Prior Publication Data

US 2006/0187033 A1 Aug. 24, 2006

Related U.S. Application Data

(63) Continuation of application No. 10/784,849, filed on Feb. 23, 2004, now Pat. No. 7,038,585.

(60) Provisional application No. 60/449,541, filed on Feb. 21, 2003, provisional application No. 60/449,380, filed on Feb. 21, 2003.

(51) Int. Cl.
*G08B 1/08* (2006.01)

(52) U.S. Cl. ..... 340/539.22; 340/431; 340/539.13; 340/541; 340/988; 235/385; 220/200

(58) Field of Classification Search ..... 340/539.22, 340/988, 541, 431, 539.13, 539.26, 5.2, 5.33, 340/10.1, 10.5; 235/385, 375, 376; 700/225
See application file for complete search history.

(56) References Cited

U.S. PATENT DOCUMENTS 4,591,835 A * 5/1986 Sharp ..... 340/574
5,153,561 A * 10/1992 Johnson ..... 340/571

(Continued)

FOREIGN PATENT DOCUMENTS

EP 0748082 12/1996

(Continued)

OTHER PUBLICATIONS

US/RO; International Search Report, PCT/US04/05307, Sep. 15, 2005, 3 pages.

(Continued)

*Primary Examiner*—Davetta W. Goins
(74) *Attorney, Agent, or Firm*—J. Bennett Mullinax, LLC

(57) ABSTRACT

A security apparatus is disclosed which provides for a cargo asset monitoring and tracking capability. The security apparatus may contain a physical locking function which provides a physical deterrent to an attached item such as a shipping drum. A microcontroller is provided within the security apparatus which monitors and coordinates locking/unlocking functions of the security apparatus, monitors an associated sensor to detect alarm conditions, monitors information from an RF transceiver with respect to proximity alerts and monitors information from one or more sensors incorporated within the security apparatus, the sensors providing information which may indicate tampering or damage to the cargo. The security apparatus is able to provide an audible alarm as well as communicate with a remote monitoring station upon detection of an alarm condition. A tracking system and process of monitoring and controlling the security apparatus from a remote location are also disclosed.

8 Claims, 6 Drawing Sheets

U.S. PATENT DOCUMENTS

| | | | | |
|---|---|---|---|---|
| 5,825,283 | A | | 10/1998 | Camhi |
| 5,828,322 | A | | 10/1998 | Eberhard |
| 5,877,696 | A | | 3/1999 | Powell |
| 5,887,176 | A | | 3/1999 | Griffith et al. |
| 6,055,426 | A | | 4/2000 | Beasley |
| 6,133,842 | A | * | 10/2000 | Gariepy ..... 340/689 |
| 6,512,478 | B1 | | 1/2003 | Chien |
| 6,529,141 | B1 | | 3/2003 | Hanebeck et al. |
| 6,542,114 | B1 | | 4/2003 | Eagleson et al. |
| 2002/0009567 | A1 | | 1/2002 | Brand |
| 2004/0082296 | A1 | | 4/2004 | Twitchell, Jr. |

FOREIGN PATENT DOCUMENTS

| | | |
|---|---|---|
| WO | WO 06/067127 | 9/2001 |

OTHER PUBLICATIONS

US/RO, Written Opinion of the ISA, PCT/US04/05307, Sep. 15, 2005, 3 pages.

Dr. Russell Maurice, Search Report from United Kingdom Patent Office; London, England; Aug. 7, 2006; 7 pages.

* cited by examiner

CARGO LOCK AND MONITORING APPARATUS AND PROCESS

RELATED APPLICATIONS

This application is a continuation of U.S. application Ser. No. 10/784,849 filed Feb. 23, 2004, now U.S Pat. No. 7,038,585 B2, which claims benefit of U.S. application Ser. Nos. 60/449,541 and 60/449,380 filed on Feb. 21, 2003, and which are incorporated herein by reference.

FIELD OF THE INVENTION

This invention is directed towards a security device and monitoring process. The apparatus and process is adaptable for a wide number of asset tracking processes and procedures, including cargo containers. In one embodiment of the invention, a locking member for a 55 gallon drum is provided which secures the drum lid against unauthorized access and removal. The drum locking mechanism may be further equipped with a customized selection of sensor options including chemical sensors, radiation detectors, accelerometers, tilting switches, temperature sensors, and various tamper monitors. Further, the locking mechanism includes additional tamper-resistant housings which may contain power sources, global positioning satellite (GPS) tracking components, wireless two-way communication components, along with a microprocessor. The microprocessor may be used to engage/disengage the locking member as well as coordinate the operation of the additional electronic components.

BACKGROUND OF THE INVENTION

This invention relates to an asset tracking system and devices which provide positional and sensory data for cargo, vehicles, and other objects. Cargo monitoring capabilities are known such as that disclosed in U.S. Pat. No. 6,529,141 directed to a vehicle tracking and monitoring system using GPS technology and communication equipment to monitor assets for pre-determined alarm conditions.

WIPO Publication WO 03/032501 is directed to an asset-tracking system using a network of radio transceivers. Assets which can be monitored are stated to include shipping and warehoused cargo.

U.S. Pat. No. 5,887,176 describes a process of automated inventory interrogation using remote sensors to assist in inventory monitoring.

U.S. Pat. No. 6,055,426 describes a mobile cargo unit having a telecommunications package including a GPS module which provides notification when a mobile cargo unit is out of a coverage area. The system configuration facilitates the storage and delayed transmission of information when the mobile cargo unit re-enters a coverage area.

U.S. Pat. No. 6,512,478 is directed to a system of radio frequency (RF) tags in association with nearby relay stations to monitor and track various assets such as a manufacturer's inventory, airport luggage, or similar items within a defined relay coverage area.

While numerous techniques and devices are used to monitor and track a variety of assets, there remains room for variation and improvement within the art.

SUMMARY OF THE INVENTION

It is one aspect of at least one of the present embodiments to provide for a security apparatus which may be used to monitor a cargo container. One such application includes a closure locking apparatus for securing a lid to a drum or barrel.

It is yet another aspect of at least one embodiment of the present invention to provide for a drum locking apparatus which prevents removal of a drum lid from the drum. The drum locking apparatus provides for a physical, locked engagement with the lid to prevent the removal of the lid from an associated drum. The locking mechanism is preferably provided by one or more solenoid-controlled tabs which are used to selectively engage and release a sliding member which, when engaged in a locked position, prevents the removal of the drum lid and locking apparatus from the drum. A microcontroller, responsive to external encoded signals, is used to selectively engage and disengage the solenoid tabs. Additionally, the drum locking apparatus may contain a GPS transponder; a wireless two-way communication suite; and one or more sensors used to monitor the cargo.

An additional aspect of at least one embodiment of the present invention is directed to a cargo security unit which is in physical contact with a cargo drum, shipping pallet, or other packaging container. The cargo security unit has within a sealed interior a GPS transponder, wireless two-way communication suite, a battery, microcontroller and one or more sensors designed to interact with a monitoring system. The cargo security unit, when placed on a package or other asset, provides real time sensory and GPS data/mapping information which may be transmitted to and monitored by a command center. Sensors provided within the cargo security unit ideally include physical data sensors which would register unauthorized attempts to move, tamper, or destroy the associated package/asset.

An additional aspect of at least one embodiment of the present invention provides a coordinated, multi-functional system to cargo protection and monitoring. In the transportation industry, the technology of and ability to use global positioning satellite (GPS) technology to monitor and track movement of a truck or other vehicles is well known. However, GPS tracking of a vehicle offers no information as to the integrity of the cargo, including containers or packages which may be carried within the vehicle. For instance, cargo theft, cargo damage, or tampering with cargo which occurs during transport may not be noticed until the vehicle reaches its final destination.

Accordingly, an apparatus and monitoring system is provided which facilitates the monitoring of an individual cargo container or similar asset and which can be monitored independently of any existing vehicle monitoring system. The ability to monitor an individual package or unit within a vehicle offers several advantages. For instance, hazardous cargo such as nuclear materials, hazardous waste, or other toxic materials is frequently packaged in large drums such as 55 gallon drums. The security and integrity of such cargo shipments has been given greater emphasis since hazardous cargo can be misused as a weapon in a terrorist attack.

Further, in the event of a vehicle accident involving a hazardous cargo shipment, there is a need to coordinate accident response teams and provide the response teams with real time telemetry and security data as to the cargo and the integrity of the cargo contents. In embodiments of the present invention which employ a locking apparatus as part of the cargo security, there may arise a need to disengage the locking apparatus to assist on-scene recovery personnel. Likewise, the ability to monitor remotely in real time individual cargo packages allows an immediate response should unauthorized tampering or removal be detected. As set forth below, one embodiment of the present invention permits the real time monitoring of cargo while providing an additional mechanical locking apparatus for preventing or delaying entry into the secured package.

These and other features, aspects, and advantages of the present invention will become better understood with reference to the following description and appended claims.

BRIEF DESCRIPTION OF THE DRAWINGS

A fully enabling disclosure of the present invention, including the best mode thereof to one of ordinary skill in the art, is set forth more particularly in the remainder of the specification, including reference to the accompanying drawings.

DESCRIPTION OF THE PREFERRED EMBODIMENT

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

In describing the various figures herein, the same reference numbers are used throughout to describe the same material, apparatus, or process pathway. To avoid redundancy, detailed descriptions of much of the apparatus once described in relation to a figure is not repeated in the descriptions of subsequent figures, although such apparatus or process is labeled with the same reference numbers.

Figure 1:
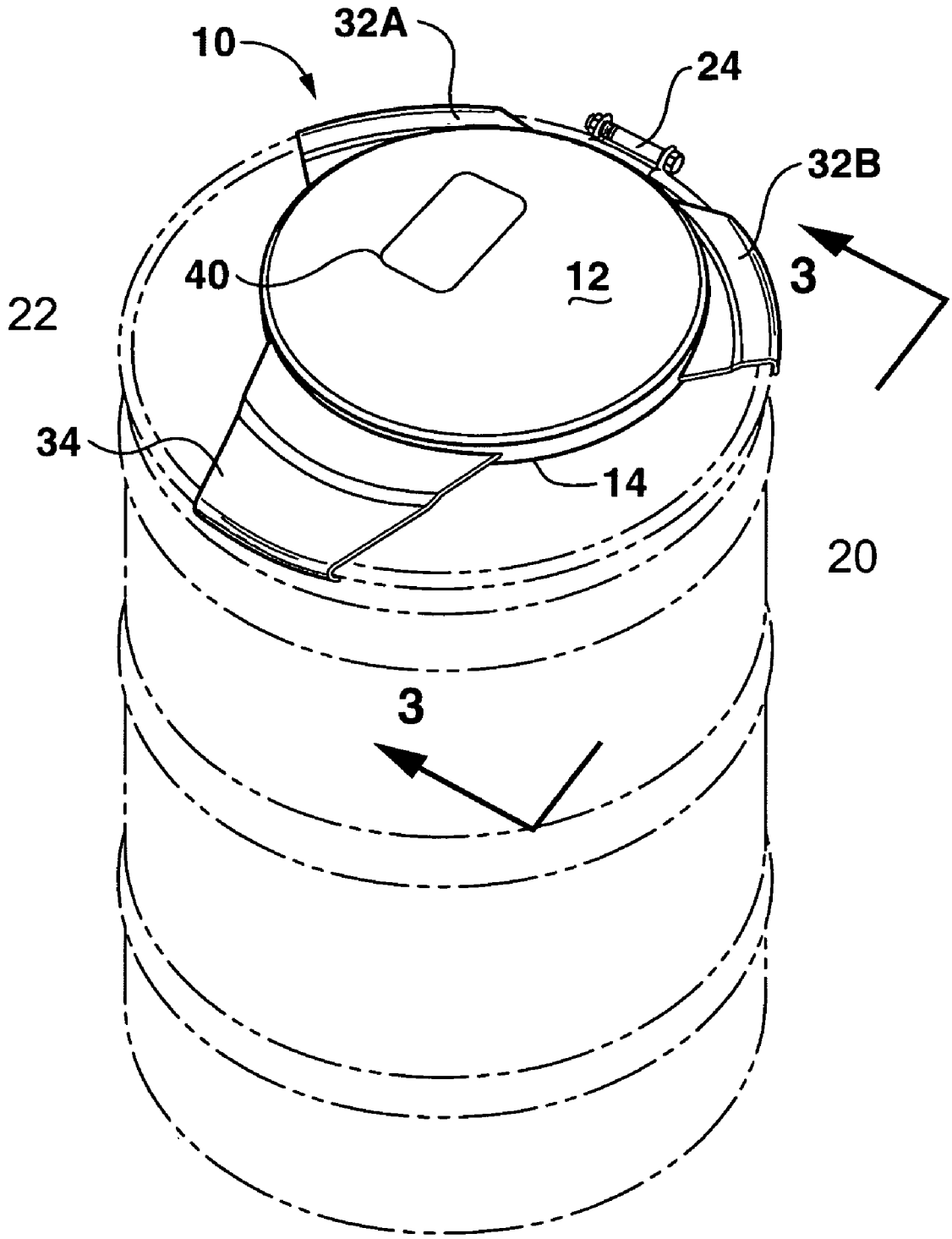
FIG. 1 is a perspective view of an embodiment of the drum locking apparatus securing a drum lid to an associated drum.

As best seen in reference to the accompanying figures, an apparatus and process is described with respect to one embodiment of a cargo locking apparatus and process. As seen in FIGS. 1 and 2, a locking apparatus 10 is provided which, in the illustrated embodiment, is adapted for engaging a cargo drum 20 along with a secured lid 22. The drum locking apparatus 10 defines an upper panel 12 and a lower panel 14. A first housing 30 is defined between the upper panel 12 and the lower panel 14. A second housing 50 is additionally defined between panel 12 and panel 14, an internal dividing wall 52 separating housing 30 from housing 50.

The locking apparatus 10 may be provided by either a metal construction such as stainless steel, or constructed from plastic. Most plastics are transparent to electronic transmissions, thereby enabling the entire communications suite to be sealed inside a housing provided for the electronics's bay. This characteristic of plastic eliminates the need for any exposed antennas. Additionally, plastic offers greater manufacturing economy for large production runs through techniques such as injection molding. Further, for cargo which may include hazardous chemicals or radioactive materials, accidents and spillage may occur as some point. A plastic locking apparatus offers a sealed, liquid, and vapor impervious housing which protects the electronic components therein. The locking apparatus may be more easily decontaminated or, if impractical, the sealed electronic package may be removed for use in a newly constructed unit.

The embodiment of FIG. 1 sets forth a locking apparatus 10 that defines a series of flanges 32A and 32B seen as extensions of lower panel 14. There is a spaced region between flanges 32A and 32B in which a conventional drum lock mechanism such as a combination securement ring with lug nut 24 may be positioned. A third flange, referred to as locking flange 34, is illustrated as equidistant between flanges 32A and 32B. As illustrated, the flanges 32A and 32B along with locking flange 34 define a "Y" shaped structure in which the lower portion of the "Y" defines the locking flange 34. As seen in reference to FIG. 2B and FIG. 3, a terminus of each arm 32A/32B and locking arm 34 defines a rolled arcuate outer edge terminus 33 which is adapted for engaging a corresponding shaped arcuate edge of a drum 20 with secured lid 22. As best seen in reference to FIG. 2A, each terminus 33 defines a lower rolled lip edge 35 which is positioned beneath the main body portion of the respective flanges 32A, 32B, and 34. The lip 35 and arcuate shape of the terminus 33 is adapted for engaging the upper rim of the drum 20 when lid 22 is attached. The particular shape of the terminal edge, along with the degree of curvature of the outer perimeter of the various arms, may be modified as needed to form the desired engagement with the edge of a particular sized drum or container shape.

Figure 2A:
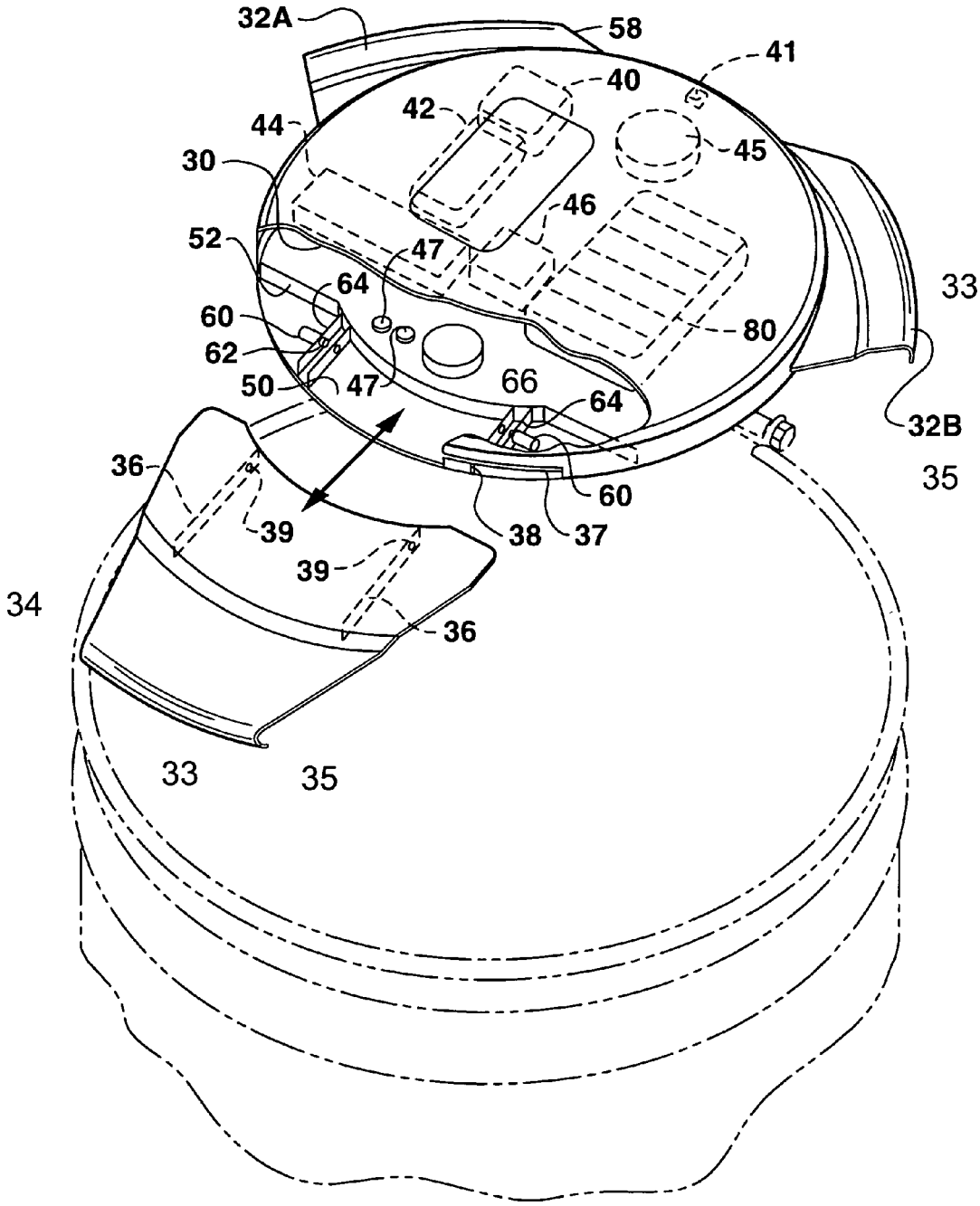
FIG. 2A is a schematic view of the drum lock apparatus seen in FIG. 1, setting forth operational details and electronic components of the locking mechanism.

As further seen in reference to FIG. 2A, the respective flanges 32A, 32B, and 34 may define an edge profile which varies over a length of the flange. As seen, the variations in edge profile allows the respective flanges to conform to any corresponding surface profile changes of the drum lid 22. In this manner, the respective flanges can conform to the surface of the drum lid and thereby provide an improved, more secure attachment of the drum lock apparatus 10.

Figure 6:
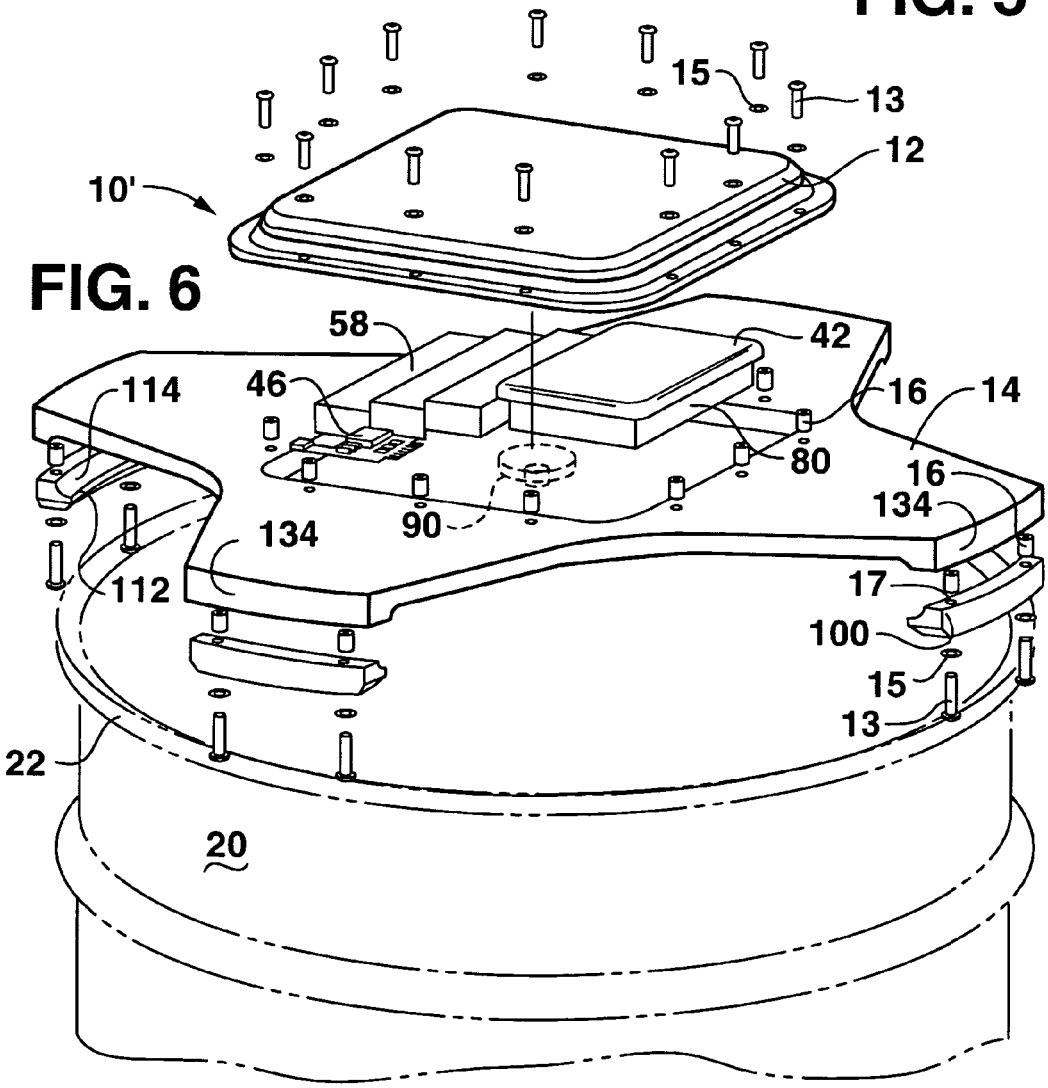
FIG. 6 is a perspective exploded view of an alternative embodiment of a security apparatus which may be attached to a drum, cargo package, or other transportation asset.

One having ordinary skill in the art will recognize that a wide variation in the number and shape of flanges may occur. Such variations may include embodiments where the entire perimeter of the drum lock apparatus defines an engaging flange to embodiments where four or more flanges may be used (FIG. 6). Where multiple flanges are used, it is also envisioned that more than one locking flange may be provided. The locking flange is described below in detail in reference to a single locking flange 34.

Figure 2B:
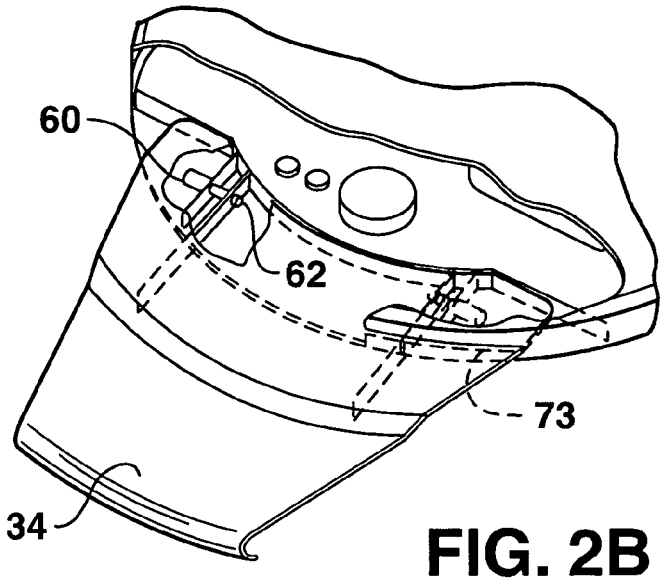
FIG. 2B is a detailed view in partial section of a locking mechanism seen in an engaged position.

As best seen in reference to FIGS. 2A and 2B, locking flange 34 may occupy a first locked position in which flange 34 is secured by one or more locking solenoids 60. Tabs 36 which project downward from a surface of flange 34 defines at least one aperture for receiving an engaging member defined by a moveable piston of the solenoid(s) 60. When the locking piston end 62 of solenoid 60 is engaged through the aligned aperture 39, defined by tab 36, flange 34 is maintained in the engaged, locked position.

As best seen in reference to FIGS. 2A and 2B, locking flange 34 may be positioned between the engaged and disengaged position by the tabs 36 which slide between openings 38 defined along a raised edge 37 of lower panel 14. When flange 34 is placed in operative engagement with the outer rim of the drum 20/lid 22, a corresponding aperture 39 defined by tabs 36 is positioned opposite the engaging locking pin 62 of solenoid 60. As seen in reference to FIG. 2A, solenoid 60 is held in position within housing 50 through attachment to a mounting clip 64. Clip 64 defines a pair of aligned apertures 66 through which locking pin 62 may extend when engaging tab 36 and aperture 39 in a locked position.

When apparatus 10 is locked in position upon a storage/shipping drum 20 with lid 22, the drum lock apparatus 10 prevents removal of the lid 22 from the drum 20. The activation/deactivation of the solenoid lock 60 with tabs 36 may be controlled by the keypad 40 (FIG. 1) and which may also include a display screen, in communication with an associated microcontroller 42. The interaction of the keypad 40, microcontroller 42, and other electronic components of the locking apparatus is described below in greater detail.

Figure 3:
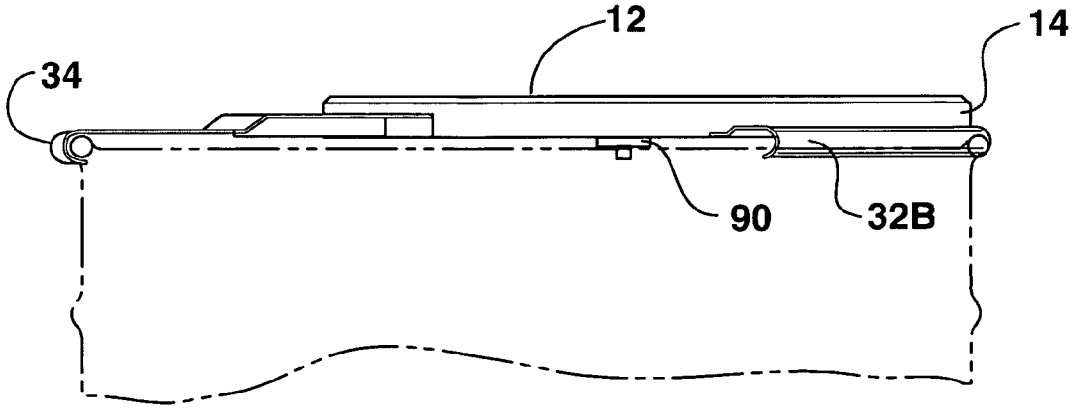
FIG. 3 is a sectional view taken along line 3-3 of FIG. 1 illustrating the location of a tamper switch with respect to the drum lid and locking apparatus.

As seen in reference to FIG. 3 and in the alternative embodiment of FIG. 6, a tamper switch 90 may be provided on the underside of locking apparatus 10 or security apparatus 10'. The tamper switch 90 may be in the form of a simple plunger-actuated device which detects when the apparatus 10/10' is engaged on a surface of a drum or other cargo asset. Other forms of a tamper switch 90 may be provided such as a proximity sensor, a light sensor, or a magnetic sensor among others. Should the locking apparatus 10 or security apparatus 10' be removed from the container, the tamper switch 90 provides a signal to the associated microprocessor 42 that the unit 10/10' has been removed.

Depending upon the selected programming of the microprocessor and control functions, the activation of the tamper switch may be used to trigger a silent alarm signal sent to a remote command center as better described elsewhere in this application. In addition to or, in the alternative, an audible alarm located on the unit 10/10' may be actuated. Subsequent actions via the command center may include alerting a driver or other personnel safeguarding the cargo and/or alerting local law enforcement agencies.

The dimensions of standard size drum containers include 85, 55, 30, 15, 10, 5, and 1 gallon drums. The dimensions are uniform within the industry and simplifies the proper construction, shape, and dimensions for securement of the locking flange or other attachment mechanism. When engaged, locking apparatus 10 prevents unauthorized access to the drum's contents. Further, with optional sensors described below, the drum lock apparatus 10 may be configured to provide security alerts in the event of cargo tampering or theft.

The components of one embodiment of the drum locking apparatus embodiment as seen in reference to FIG. 2A comprises the physical structure with flanges for engaging a container. In addition, the housing contains a battery 44, a system computer or microcontroller 42, a GPS antenna 45, a solenoid 60 responsive to the microcontroller 42, and a radio frequency transmitter/receiver unit 46. Optionally, status lights 47 may be used to indicate a lock/unlock condition of the apparatus 10 and/or to provide a low battery alert signal. In addition, an audible alarm 49 may be included as a component along with one or more sensors 80 and additional components as referenced in FIG. 4.

Figure 4:
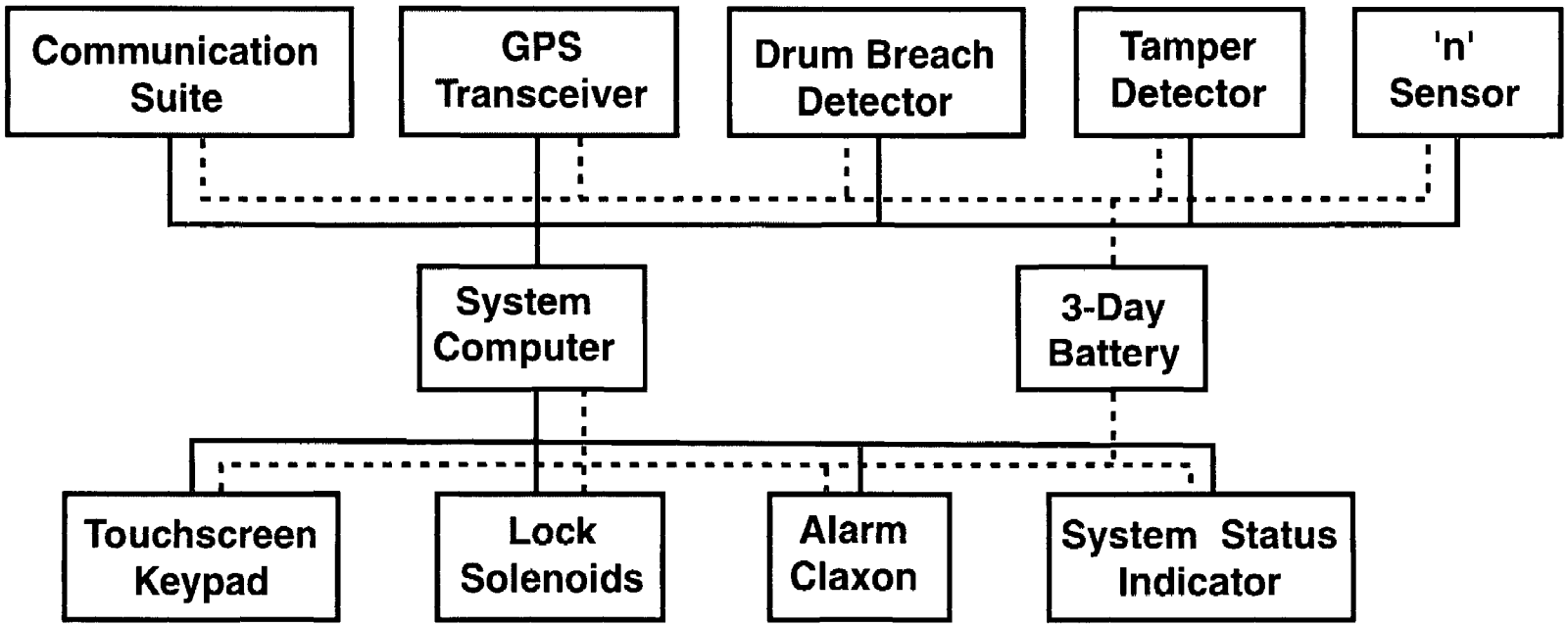
FIG. 4 is a schematic view of integrated electronic system components which may be used with a drum lock apparatus.

The various components illustrated in FIG. 4 set forth certain optional items which may be included within a drum lock apparatus 10 or security apparatus 10'. Depending upon the level of required security and cost, the various components may be selected and combined to achieve various embodiments, certain ones of which are discussed in detail herein.

Figure 5:
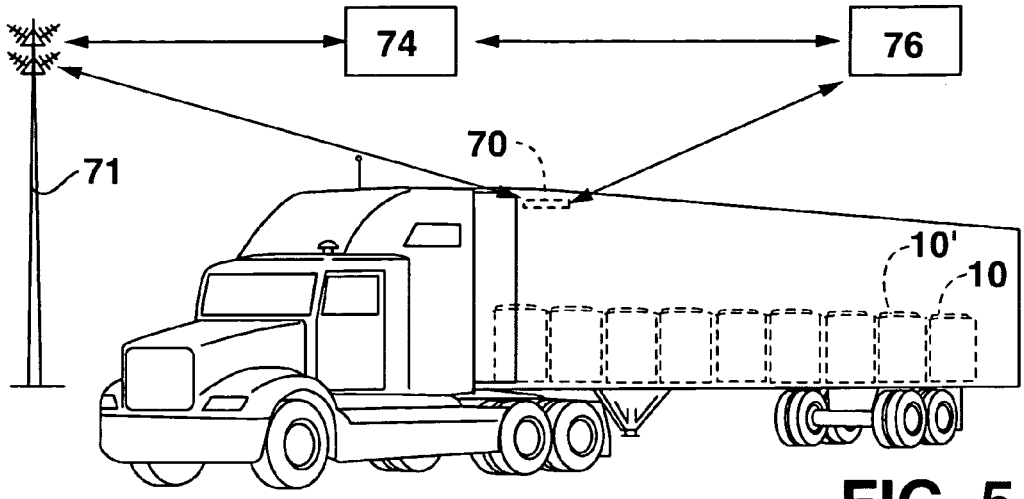
FIG. 5 is a schematic view of a system incorporating a container lock apparatus which provides for remote two-way communication and positional information to be transmitted to a monitoring station.

With respect to the electronic components and interactions set forth in FIGS. 4 and 5, the ability of the various electronic components mentioned herein all require some form of a physical or wireless interconnectivity and communication. Such interactions are shown in a schematic form and, for the purposes of clarity of the Figures, is not provided in detail. The operation of the various components is known as set for the in the following U.S. patents. These patents include U.S. Pat. Nos. 6,529,141; 6,055,426; 6,512,478; 6,542,114; and WIPO Publication WO 03/032501 and which are incorporated herein by reference in their entirety.

As is well know in the art, the RF receiver/transmitter 46 may be used to receive and/or transmit low frequency transmissions. Other forms of wireless communication components may also be included which operate in accordance with Bluetooth™ standards. However, any wireless transceiver having the capability to communicate with other wireless transceivers such as Home RF, infrared devices, Ethernet transceivers and others may be used. The RF transceiver tag or equivalent communication device uses established encryption and communication protocols to communicate with the microcontroller 42 and a remote monitor unit 70 (FIG. 5).

As best seen in reference to FIG. 2A, a numeric keypad 40 may be provided in which a lock/unlock code may be entered. Alternatively, a communications port 41 for use with a portable microcontroller may be used. The keypad operation is controlled by a microprocessor 42 which is mounted in a housing defined between the upper panel 12 and the lower panel 14. A battery 44, such as a lithium or long-life rechargeable battery, is also provided which powers the operation of the keypad, microprocessor, solenoid, and any other electronic hardware which may be included within the locking apparatus 10. When rechargeable batteries are used, a recharging port may be provided which can recharge the batteries without disassembling the locking apparatus unit.

For metal embodiments, a keypad or communication's port is desired to allow input of commands to the microcontroller. Embodiments of a plastic security apparatus 10' (FIGS. 6 and 7), are largely transparent to various forms of wireless communication, and do not require a keypad or any exposed electronic components for operation. Rather, all the electronic components including a wireless receiver may be contained within one or more sealed housings defined by the apparatus 10'.

Figure 7:
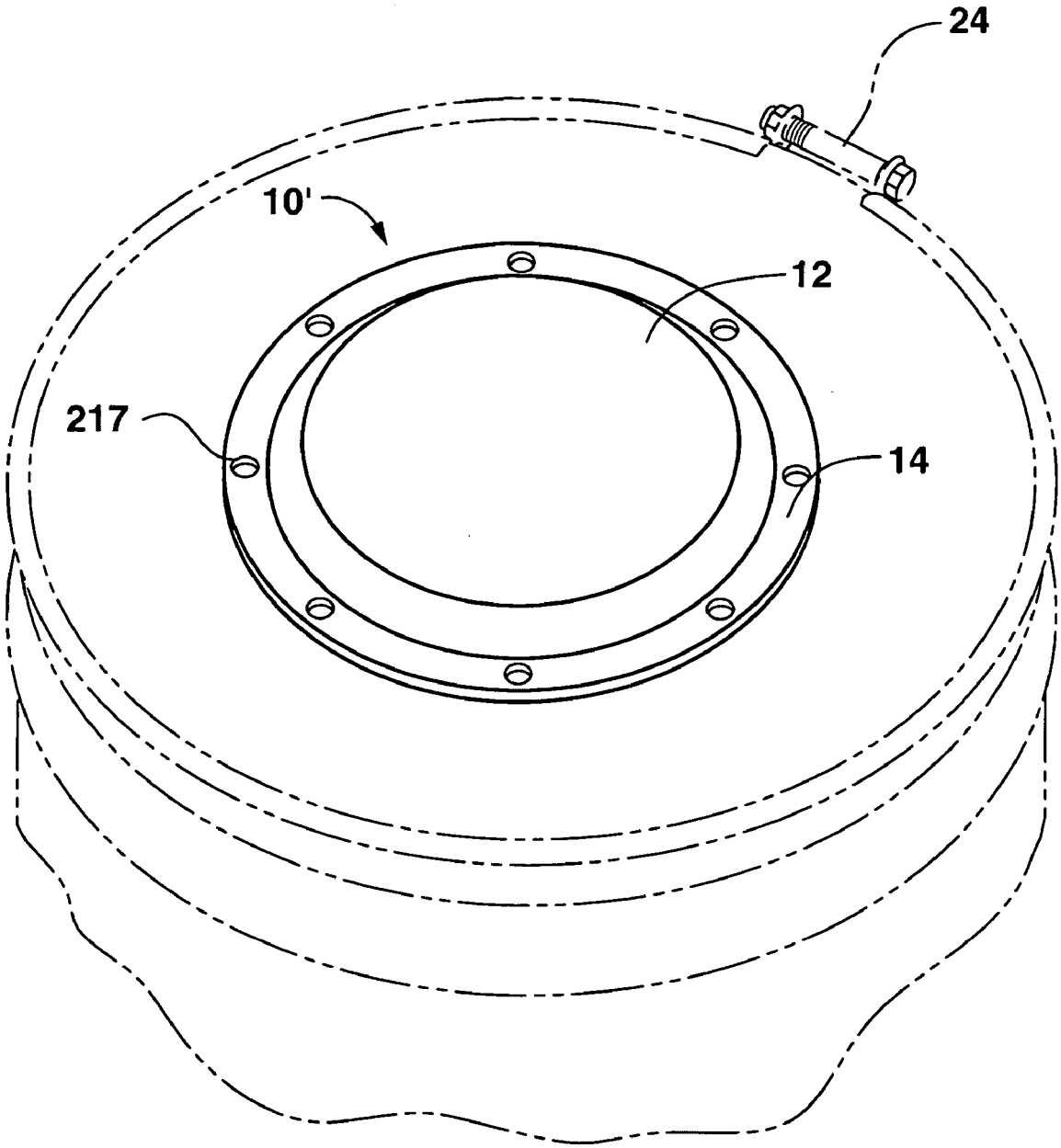
FIG. 7 is a perspective view of an additional embodiment of a security apparatus which may be attached to a commercial cargo asset.

As further seen in reference to FIGS. 6 and 7, alternative embodiments of the invention are provided in the form of a security apparatus 10'. As seen in reference to the electronic schematic of FIG. 4 and the details of FIGS. 6 and 7, the security apparatus 10' may further define a wireless modem 58; a GPS transceiver 45; an audible alarm 49; and an expandable array of sensors 80. Available sensors may include, among others, radiation detectors, temperature detectors, motion sensors, vibration sensors, accelerometers, tilt switches, chemical sensors, or fire/smoke sensors. While many of the functional electronic and communication components are identified as physically separate items, it is readily appreciated and understood by one of ordinary skill in the art that a single, multifunctional unit may be provided which combines multiple functions.

As seen in reference to the embodiment illustrated in FIG. 6, a security apparatus 10' can be provided which does not utilize a remote locking/unlocking feature. Instead, the security apparatus 10' relies upon a series of internal sensors along with a manual engagement to the container which prevents removal of the container's lid.

As illustrated in FIG. 6, an upper panel 12 and a lower panel 14 define a housing 30 therebetween in which an array of electronic components (as previously described) may be installed in operative and cooperative engagement. Alternatively, a single panel member can be provided which provides an integral housing which may contain the electronic components. Positioned beneath panel 14 is a tamper switch 90. A series of engagement members 13 such as screws, rivets, or bolts are used in association with washers 15 to secure panel 12 and panel 14 together. A metal sleeve 16 may be positioned along apertures defined within the respective panels 12 and 14 for receiving engaging members 13. Engaging members 13 are preferably in the form of a tamper resistant threaded fastener which requires a special service tool to install or remove.

While engaging members 13 is illustrated as being installed from an upper surface of security apparatus 10', the engagement members 13 can also be installed from a lower surface of apparatus 10'. Such positioning of the members 13 may provide additional resistance to tampering with security apparatus 10' when the apparatus is installed on a container as described below.

Security apparatus 10' defines a series of arm-like extensions of panel 14 which may project in part beyond the upper surface of the cargo unit such as drum 20 having lid 22. A plurality of retention flanges 134 are defined along the terminus of each extension. A portion of flange 134 may extend beyond the surface of the drum 20/lid 22 and provide an attachment site for a corresponding bracket 100. Bracket 100 is secured to the lower surface of flange 134 and may use similar engagement members 13, washers 15, and sleeves 16 as previously described. The attachment hardware is inserted through openings 17 defined within bracket 100. Alternatively, a bracket 100 may be provided as a unitary construction such as an injection molded plastic. The bracket 100 may be attached to either an outer edge of corresponding flange 134 or to the lower flange surface as illustrated.

Bracket 100 defines an innermost lip 112 which is formed in part by a tapering inner surface 114 of bracket 100. Lip 112 engages the lower rim of a drum 20/lid 22 container and prevents the removal of the lid 22 from the drum 20. As seen in reference to FIG. 6, bracket 100 may have the inner and the outer edges in the form of an arcuate shape configured to the dimensions of the upper container's perimeter edges. As illustrated, this embodiment of the security apparatus 10' is placed and secured to the cargo container through the engagement of brackets 100 to the flange 134. Upon arrival of the cargo at a destination, the bracket 100 can be removed, allowing normal access to the drum 20 and lid 22.

While the embodiment seen and described in relation to FIG. 6 does not provide for a remote locking/unlocking capability, the security apparatus 10' does provide for a physical securement of the lid to the drum when installed. An unauthorized effort to remove the security apparatus 10' or gain access to the container will trigger one or more of the sensors 80 contained within the security apparatus 10'. Further, tamper switch 90 provides an additional monitoring function should the security apparatus 10' be removed from the container.

Alternatively, the security apparatus 10' may be provided in an embodiment in which at least two flanges and two brackets are present. The dimensions of the flange arms and associated brackets are such that when positioned onto an appropriate sized drum, applied pressure will snap-fasten the apparatus 10' onto the drum 20/lid 22. A suitably tight fit may be established such that considerable force is required to unfasten the apparatus 10' from the drum 20. Such removal efforts are detected by the associated sensors. An embodiment have three fixed position arms and engaging structure similar in appearance to the embodiment seen in FIG. 1 may be provided. Such an embodiment may be installed by positioning two of the arms in an engaged position whereby the third arm is pressed downwardly. The pressure forces the third arm and appropriate lip/bracket over the drum rim, thereby "locking" the security apparatus and lid 22 onto the drum.

An additional embodiment of a security apparatus 10' is seen in reference to FIG. 7. In this embodiment, the security apparatus 10' has an upper panel 12 and a lower panel 14 defining a housing therebetween. As set forth in the previously described embodiments, a variety of electronic components, including sensors, communication devices, and tamper switches may be incorporated into the construction of the security apparatus 10'. The perimeter of security apparatus 10' defines a plurality of apertures 217 which may be used to secure the security apparatus 10' to a cargo asset using similar attachment hardware as described above in reference to the embodiment of FIG. 6. Alternatively, other forms of mechanical attachment may be used including semi-permanent installations using ultrasonic welding, thermoset adhesives, or similar techniques. Preferably, security apparatus 10' has the central housing formed of an electromagnetically transparent plastic. The housing defined between upper surface 12 and lower surface 14 is preferably sealed against liquid and vapor. While the embodiment of FIG. 7 does not provide for a physical locking mechanism for preventing access to the cargo container, upon appropriate selection of sensors, the security apparatus can provide an alert mechanism should unauthorized tampering occur.

While not separately illustrated, a suitable security apparatus 10' may be provided which is integral with an existing drum lid 22. In such an embodiment, a housing can be provided on the upper surface of drum lid 22 which contains the various electronic components, communication devices, and sensors. As such, the normal securement mechanisms such as a compressive fit and/or a lug bolt securement ring can be used to provide physical engagement between the lid 22 and the drum 20. When lid 22 physically incorporates the necessary housing and electronic hardware, sensors and other communication hardware within the housing will provide a warning alert should tampering of the container occur.

While the embodiment of FIG. 7 is shown attached to a cargo drum, it is readily appreciated that the security apparatus 10' could be attached to a variety of cargo packaging materials including pallets, boxes, cartons, or cargo pods. The security apparatus sensors and communication arrays allow for an electronic barrier to be associated with individual cargo assets. Upon selected, monitored conditions, an appropriate alarm notification may be sent to a remote command center. The alarm notification may include the activation of an optional audible alarm feature contained within security apparatus 10'.

While not separately illustrated, any of the embodiments of the locking apparatus or security apparatus described herein may have a battery charger port associated therewith to permit recharging of the battery. Alternatively, solar regenerative charging or a vibratory charging mechanism may be provided to recharge the battery or otherwise replenish a power source. In addition, while the drum locking apparatus 10 and security apparatus 10' have been described as a separate component for use with a container, it is readily understood and appreciated that a drum lid 22 could be constructed in which a drum lock apparatus 10 or security apparatus 10' may be an integral part of the lid 22. For instance, a surface of lid 22 may define the lower panel 14 to which an upper panel 12 is attached.

As best seen in reference to FIG. 5, the cargo lock apparatus 10 or security apparatus 10' may be one component in a monitoring/relay system. An additional system component includes a monitor unit 70 as seen positioned along a ceiling area of a cargo trailer. The illustrated system recognizes the fact that typical cargo containers are metallic which inhibits GPS transmissions. Positioning the monitor unit 70 outside the cargo container allows for proper GPS send/receive. Communication between monitor 70 and drum locking apparatus 10 and/or security apparatus 10' may make use of RF transmission/receive communication devices which are not typically inhibited by metal. The monitor unit 70 provides a communication link between the individual container lock apparatuses 10 or security apparatus 10', a remote command center 74, and orbiting Global Positioning Satellite 76. The monitor unit has a GPS transponder, microcontroller and a secure wireless communication package designed to transmit and receive data and commands from a remote command center to the container lock unit 10/security apparatus 10' in proximity to the monitor unit. It is through the monitor unit that the security access (lock/unlock), proximity alarms, various sensors, electronic manifest data and various operational parameter rules and communications are transmitted and controlled. Communications from the command center to/from the monitor unit 70 may include cellular, satellite, or other forms of wireless, secure communication. Such communication protocols and equipment which provide secured communication are well known in the art.

The command center 74 remotely tracks and manages the container lock apparatus 10/security apparatus 10' and associated cargo. Using established GPS mapping and tracking software, real time positional information can be gathered and tracked. Further, data collected by the sensors 80 of the individual apparatuses 10/10' can be monitored. Through the command center, instructions and alarm conditions can be relayed through monitoring unit 70 to the individual container lock unit 10/security apparatus 10'.

For instance, in the illustrated example of FIG. 5, a truck's cargo can be outfitted with the monitoring system components described herein. The command center will receive periodic updates of GPS and sensor information for either drum lock 10 or security apparatus 10' on a reporting schedule which may be adjusted as needed by instructions issued from the command center. The driver can inform the command center of meal breaks or overnight stops which provide the command center the option of changing reporting protocols, such as frequency. In addition, the reporting protocols may also be changed to set new alarm report thresholds for GPS or sensor data.

For example, where the cargo transit is halted for an overnight stop, the alarm conditions may be established such that any GPS detected movement triggers an alarm report to the command center. Similarly, motion sensors, tilt sensors etc., can also have an increased sensitivity threshold established so that even a low threshold of detection will be transmitted as an alarm condition to the command center. From the command center, sensory and reporting data can be monitored with appropriate follow-up action such as local law enforcement contact an/or establish contact with the driver for further investigation.

Through the command center 74, the container lock unit 10/security apparatus 10' can be programmed to signal an alert should there be deviation from an accepted transportation route. Should the cargo fall outside of an accepted transit location with associated timelines, an alarm feature will be activated signaling the command center of a possible alarm condition. Such functions are reprogrammable during transit such that delays caused by weather, traffic conditions, or mechanical problems may be incorporated into a new route and timeline program.

In the case of potentially hazardous materials such as radioactive materials or hazardous chemical inventories, enhanced reporting and monitoring can be implemented at any time. For instance, during times of heightened security alerts, more frequent monitoring protocols of sensitive cargo may be initiated.

Other useful scenarios include shipments of perishable goods such as those requiring refrigeration. A temperature sensor could provide advance warning of a compressor or other refrigeration equipment failure associated with a cargo shipment. As a result, an appropriate detour or repair may be initiated which may prevent the loss of a perishable cargo.

The command center can make available to customers/subscribers, real time access to data via a secure internet connection. Typically, an internet connection is a "monitor only" viewing platform without an ability to directly interact with the system parameters. In this manner, a customer may monitor appropriately tagged cargo and may communicate with the command center if needed. Actual control of the locking or security apparatus 10/10', monitoring unit 70 and command center 74 resides at all times with the operators within the command center. Additionally, the command center may issue routing reports or alerts to designated customers or subscribers via cell phone, pager, or e-mail.

The tracking and monitoring of a secure cargo package offers greater flexibility when three operational components are present. These operational components include the container lock apparatus 10 and/or security apparatus 10', a monitor station 70 associated with a cargo carrier or warehouse, and a remote command center 74. The container lock apparatus and associated communication devices have been described above. For many applications, it is desirable that the container lock apparatus 10 be subject to remote monitoring and control. For instance, in case of an accident or emergency, a remote command center may be used to remotely unlock the container lock apparatus, deactivate alarm functions, or take other action to assist local authorities or emergency response teams.

In instances where electronic communication between the container lock apparatus 10 or security apparatus 10' and the remote call center is possible, the remote call center may use satellite or cellular communications to establish contact and command authority over the container lock apparatus. More commonly, the shipping and cargo transit requirements are such that direct lines of communication between a container lock apparatus and a remote call center are unreliable given interference from a cargo trailer, pod, or warehouse. To address these issues, a local monitoring unit 70 may be provided as seen in reference to FIG. 5. The monitoring unit 70 is placed in close proximity to the cargo having a container lock apparatus 10 or security apparatus 10' and provides a reliable communication and control node between the container lock apparatus and a remote command center. The monitoring unit 70 may include a GPS module to allow tracking and monitoring of the cargo via the GPS transceiver in the container lock apparatus. This connection allows the remote command center to monitor the position and movement of the individual cargo units having the container lock apparatus.

Optionally, the monitoring units provide two-way communication capabilities with the container lock apparatus 10 or security apparatus 10' through a device such as a radio frequency (RF) receiver/transmitter 46 which may receive and send information to and from the monitoring unit.

The monitoring unit 70 provides enhanced communications capability between the remote call center and the container lock apparatus 10 or security apparatus 10'. As such, the remote command center may, via the monitoring unit, send and receive information to and from the apparatus 10/10'. Using well established communication and security protocols, the remote command center may issue instructions to lock/unlock the container lock apparatus 10, may monitor the sensor data of the container lock apparatus 10 or security apparatus 10', may monitor the GPS telemetry data from individual apparatuses 10/10', receive alarm conditions should an apparatus 10/10' be removed from an authorized location or deviate from an accepted route.

The present system provides a powerful tool for real time data acquisition and management of assets protected with the container lock apparatus. For instance, a driver of a cargo vehicle can call a command station to indicate that he is "going stationary" for a meal break. Accordingly, the container lock or security apparatus 10/10' can be programmed to provide immediate alarm notification should any motion or movement be detected via the GPS transponder or other sensors. Following a meal break, the driver can again contact the remote command center to indicate that normal travel will resume. Accordingly, the alarm communication parameters may be changed to reflect the updated status of the cargo and cargo movements.

The remote command center facilitates multiple levels of interaction and monitoring. For instance, with appropriate mapping software and communications software, multiple authorized parties may track cargo movement and conditions via internet monitoring.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention which is set forth in the following claims. In addition, it should be understood that aspects of the various embodiments may be interchanged, both in whole, or in part. Therefore, the spirit and scope of the appended claims should not be limited to the description of the preferred versions contained therein.

That which is claimed:

1. A security apparatus for attachment to a transported item comprising:

an upper panel;

a lower panel positioned beneath said upper panel;

a housing defined between said upper and said lower panels;

a global positioning satellite transceiver positioned within said housing;

a microcontroller positioned within said housing;

a radio frequency transceiver positioned within said housing;

at least one sensor contained within said housing; and, an audible alarm device;

wherein, said security apparatus signals through said audible alarm device when said sensor signals an alarm condition.

2. The security apparatus according to claim 1 wherein said sensor is selected from the group of sensors consisting of a radiation sensor, a motion sensor, an accelerometer, a tilt sensor, a vibration sensor, a temperature sensor, a fire sensor, a smoke sensor, and a chemical sensor.

3. The security apparatus according to claim 1 wherein said security apparatus contains within said housing a two-way communication device adapted for providing communication with a remote monitoring station.

4. The security apparatus according to claim 1 wherein said radio frequency transceiver provides a proximity monitoring capability, said RF transceiver signaling said audible alarm device when said security apparatus is removed from a defined location.

5. A cargo security apparatus comprising:

a base member;

a cover member secured to said base member, said base member and said cover member defining the housing therebetween;

a first engagement arm defined by one of said base member or said cover member adapted for securing to a first edge of a cargo container;

a second engagement arm defined by one of said base member or said cover member and adapted for securing to a second edge of a cargo container;

wherein, when said first engagement arm and said second engagement arm operatively engage respective first and second edges of a cargo container, said security apparatus prevents opening of the cargo container.

6. The drum security apparatus according to claim 5 wherein said cargo security apparatus defines a third engagement arm defined by one of said base member or said cover member and adapted for securing to a second edge of a cargo container.

7. The cargo security apparatus according to claim 5 wherein said drum security apparatus defines further defines a tamper switch.

8. The cargo security apparatus according to claim 5 wherein said housing contains therein a microcontroller which is in further communication with at least one sensor contained within said housing.

* * * * *